US010160920B2

(12) United States Patent
Rajagopalan et al.

(10) Patent No.: US 10,160,920 B2
(45) Date of Patent: Dec. 25, 2018

(54) SEQUENTIAL CRACKING PROCESS

(71) Applicants: Saudi Basic Industries Corporation, Riyadh (SA); SABIC Global Technologies, B.V., PX Bergen Op Zoom (NL)

(72) Inventors: Vijayanand Rajagopalan, Bangalore (IN); Ravichander Narayanaswamy, Bangalore (IN); Arno Johannes Maria Oprins, Geleen (NL)

(73) Assignees: SAUDI BASIC INDUSTRIES CORPORATION, Riyadh (SA); SABIC GLOBAL TECHNOLOGIES B.V., Bergen op Zoom (NL)

( * ) Notice: Subject to any disclaimer, the term of this patent is extended or adjusted under 35 U.S.C. 154(b) by 15 days.

(21) Appl. No.: 15/120,691

(22) PCT Filed: Dec. 23, 2014

(86) PCT No.: PCT/EP2014/079235
§ 371 (c)(1),
(2) Date: Aug. 22, 2016

(87) PCT Pub. No.: WO2015/128044
PCT Pub. Date: Sep. 3, 2015

(65) Prior Publication Data

US 2017/0009149 A1 Jan. 12, 2017

(30) Foreign Application Priority Data

Feb. 25, 2014 (EP) ..... 14156628

(51) Int. Cl.
*C10G 51/02* (2006.01)
*C10G 51/00* (2006.01)

(52) U.S. Cl.
CPC ... *C10G 51/023* (2013.01); *C10G 2300/1077* (2013.01); *C10G 2300/4006* (2013.01)

(58) Field of Classification Search
CPC ..... C10G 51/00; C10G 51/02; C10G 51/023
See application file for complete search history.

(56) References Cited

U.S. PATENT DOCUMENTS 1,958,959 A 5/1934 Stratford
3,245,900 A 4/1966 Paterson ..... 208/56
(Continued)

FOREIGN PATENT DOCUMENTS

EP 0005643 A2 11/1979
GB 2138840 A 10/1984
(Continued)

OTHER PUBLICATIONS

Speight, J.G. (1999). The Chemistry and Technology of Petroleum, 3rd edition, Marcel-Dekker, 918 pgs (Office action cites pp. 576 & 577).*

(Continued)

*Primary Examiner* — Brian A McCaig
(74) *Attorney, Agent, or Firm* — Norton Rose Fulbright US LLP

(57) ABSTRACT

A sequential cracking process for the thermal cracking of a hydrocarbon feedstock in a cascade of cracking units wherein said hydrocarbon feedstock is heated in a furnace to a predetermined maximum temperature and thermally cracked in the cascade of cracking, such that the formation of coke is reduced.

11 Claims, 1 Drawing Sheet

(56) References Cited

U.S. PATENT DOCUMENTS

| | | | | |
|---|---|---|---|---|
| 4,201,657 | A * | 5/1980 | Anderson | C10L 9/10 208/23 |
| 4,698,147 | A * | 10/1987 | McConaghy, Jr. | C10G 47/34 208/107 |
| 4,762,608 | A * | 8/1988 | Didchenko | C10B 55/00 208/111.1 |
| 6,086,647 | A * | 7/2000 | Rahm | C10L 9/10 252/88.1 |
| 6,153,087 | A | 11/2000 | Bigeard et al. | |
| 6,270,654 | B1 | 8/2001 | Colyar et al. | |
| 7,214,308 | B2 | 5/2007 | Colyar | |
| 7,704,377 | B2 | 4/2010 | Duddy et al. | |
| 7,938,952 | B2 | 5/2011 | Colyar et al. | |
| 8,926,824 | B2 | 1/2015 | Morel | |
| 9,005,430 | B2 | 4/2015 | Fournier et al. | |
| 9,840,674 | B2 | 12/2017 | Weiss et al. | |
| 2008/0093262 | A1 | 4/2008 | Gragnani et al. | |
| 2014/0061100 | A1 * | 3/2014 | Lattner | C10G 75/00 208/48 Q |
| 2014/0299515 | A1 | 10/2014 | Weiss et al. | |
| 2016/0122666 | A1 | 5/2016 | Weiss et al. | |

FOREIGN PATENT DOCUMENTS

| | | |
|---|---|---|
| JP | S59-025886 | 2/1984 |
| JP | S59-157180 | 9/1984 |
| JP | S60-235890 | 11/1985 |
| WO | WO 2016/146326 | 9/2016 |

OTHER PUBLICATIONS

Hoffman, H.L. et al. (2005) Instrument Engineers' Handbook, vol. 2: Process Control and Optimization, 4th Edition, edited by Bela G. Liptak, CRC Press, 2464 pgs [Office action cites p. 1828].*

International Search Report and Written Opinion of International Application No. PCT/EP2014/079235; 9 pages; dated Feb. 2, 2015.

* cited by examiner

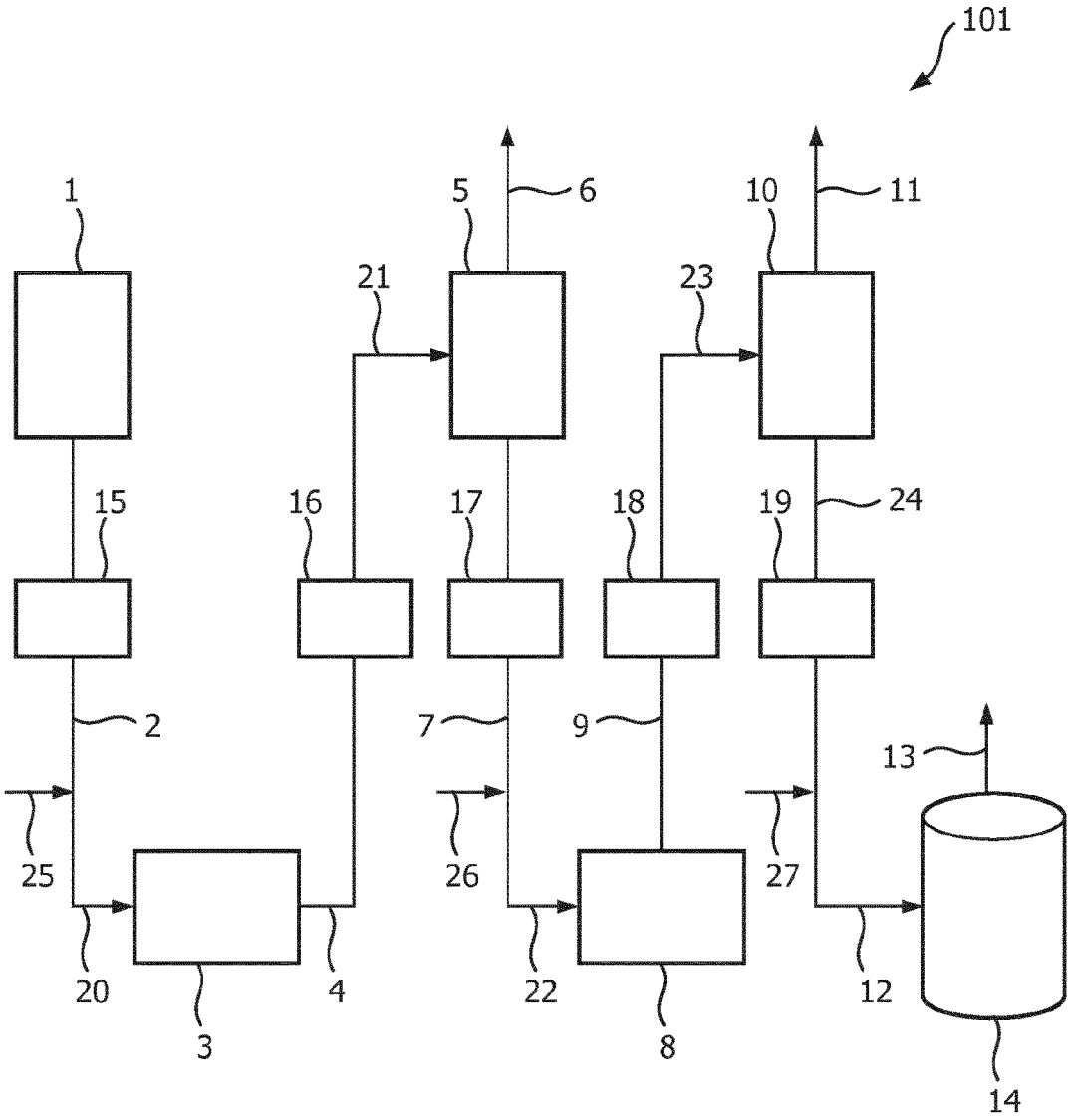
101
1
5
6
10
11
21
23
15
16
17
18
19
24
2
7
9
13
25
26
27
20
4
22
12
3
8
14

SEQUENTIAL CRACKING PROCESS

CROSS-REFERENCE TO RELATED APPLICATIONS

This application is a national phase under 35 U.S.C. § 371 of International Application No. PCT/EP2014/079235, filed Dec. 23, 2014, which claims the benefit of priority to European Patent Application No. 14156628.1, filed Feb. 25, 2014, the entire contents of each of which are hereby incorporated by reference in their entirety.

TECHNICAL FIELD AND BACKGROUND OF THE INVENTION

The present invention relates to a sequential thermal cracking process for the thermal cracking of a hydrocarbon feedstock in a cascade of cracking units where the hydrocarbon feedstock is heated in a furnace to a predetermined maximum temperature and then thermally cracked in the cascade of cracking units.

EP 0 005 643 relates to a process of converting petroleum residuum to distillate products and premium coke. A heavy liquid hydrocarbonaceous material having an initial boiling point above 340° C. is combined with a hydrogen donor diluent and fed to a cracking furnace, operating at a temperature of from 480 to 540° C. and a pressure of 10.5 to 70 kg/cm2. The furnace effluent passes to a fractionator, where gases and distillates are taken off the upper section through lines, and a gas-oil fraction is taken off the mid portion of the fractionator, combined with hydrogen, and hydrogenated in a catalytic hydrotreater for reuse as hydrogen donor diluent. A portion of the hydrotreated gas-oil from the hydrotreater 14 is combined with the pitch fraction boiling above 510° C. from the bottom of the fractionator, and passed to a coker furnace where it is heated to coking temperature. The coker furnace effluent is then passed to a delayed coke drum for formation of premium coke. Vapors from the coke drum are returned to the fractionator, and coke is withdrawn from the bottom of coke drum. This document also teaches the addition of a second stage cracking furnace and a flash to remove light ends from the coker feedstock, wherein a first portion of the hydrogen donor diluent, after passing through the hydrotreater, is fed to the second stage cracking furnace, and a second portion is fed to the coker furnace.

U.S. Pat. No. 1,958,959 relates to the cracking of hydrocarbon oils for the production of lower boiling products such as gasoline or naphtha distillates, comprising passing fresh clean charging oil through a heating zone wherein it is raised to a cracking temperature under pressure, subjecting the resulting hot oil in a primary cracking zone to cracking temperatures at a superatmospheric pressure to effect cracking and vaporization, subjecting evolved vapors to fractionation to form a vapor fraction of light distillate and a higher boiling point condensate, withdrawing the condensate from the fractionating zone, passing condensate so withdrawn to heat the oil to a cracking temperature higher than that obtaining in the primary cracking zone, directing the oil thus heated into an enlarged digestion zone and maintaining the oil therein at a substantially constant temperature higher than that obtaining in the primary cracking zone and under higher pressures to effect cracking and digestion, expanding the cracked products from the enlarged zone into the primary cracking zone for distillation and preventing residual products of cracking from entering the heating zone.

GB 2 138 840 relates to a process for thermally cracking a heavy hydrocarbon oil, comprising the steps of: (a) feeding the heavy hydrocarbon oil into a first thermal cracking zone for thermally cracking the heavy hydrocarbon oil and for obtaining a first, thermally cracked product; (b) introducing the first product into a second thermal cracking zone for thermally cracking the first product and for obtaining a second, thermally cracked product and a pitch product, the second cracking zone having a plurality of cracking reactors which are connected in series, through which is successively passed the first product and to each of which is supplied a gaseous heat transfer medium to maintain the liquid phase therein, including the first product, at a temperature sufficient for effecting the thermal cracking and to strip the resulting distillable, cracked components from the liquid phase, the thermal cracking temperature in one reactor being so controlled as to become higher than that in its adjacent upstream-side reactor, the distillable, cracked components in respective reactors being removed overhead therefrom as the second product, the liquid phase in the downstream-end reactor being discharged therefrom for recovery as the pitch product; (c) separating the second product into a heavy fraction and a light fraction, (d) recovering the light fraction as a light product oil, (e) introducing the heavy fraction into a third thermal cracking zone for thermally cracking same and for obtaining a tar-containing product; and (f) recycling the tar-containing product to at least one of the reactors of the second thermal cracking zone. In the second thermal cracking zone the thermal cracking in the first cracking reactor is performed at a temperature of between 400 and 420 degr. C., that in the second reactor is between 410 and 430 degr. C. and that in the third reactor is between 420 and 440 degr. C.

U.S. Pat. No. 3,245,900 relates to a hydrocarbon conversion process wherein a reduced crude oil feed is supplied to vacuum distillation column, wherein the light gas oil is passed to hydrocracking zone, gasoline and lighter fractions comprising C4-hydrocarbons are withdrawn from the system, through line 8, the heavy gas oil is passed to a catalytic cracking zone, light cycle oil is passed to a hydrocracking zone, heavy cycle oil is passed to hydrocracking zone. Residuum is passed to solvent deasphalting, wherein the deasphalted oil is passed to a hydrocracking zone, to a coking zone, or to a thermal cracking zone.

US Patent application No 2012/298552 discloses a delayed coking process for the thermal cracking of whole crude oil in a delayed coking unit, where the whole crude oil feed stream is heated in a furnace and introduced into the delayed coking unit, wherein the gaseous and liquid product stream from the delayed coking unit are passed to a delayed coking unit fractionating column for recovering as separate side streams from the fractionating column naphtha, light gas oil and heavy gas oil, and recycling a portion of the heavy gas oil and reintroducing it with the coking unit product stream into the fractionating column. At least a portion of the fractionating column bottoms is mixed with the whole crude oil feed stream to form a mixed feed stream and introduced into the furnace.

Delayed coking is a thermal cracking process used in petroleum refineries to upgrade and convert petroleum residuum, which are typically the bottoms from the atmospheric and vacuum distillation of crude oil, into liquid and gas product streams leaving behind petroleum coke as a solid concentrated carbon material. A fired heater or furnace, e.g., of the horizontal tube type, is used in the process to reach thermal cracking temperatures of 485[deg.] C. to 505[deg.] C. With a short residence time in the furnace tubes, coking of the feed material is thereby "delayed" until it is discharged into large coking drums downstream of the heater.

In the practice of the delayed coking process, hydrocarbon oil is heated to a coking temperature in a furnace or other heating device and the heated oil is introduced into a coking drum to produce a vapour phase product, which also forms liquid hydrocarbons, and coke. The drum can be decoked by hydraulic means or by mechanical means. In most configurations of the delayed coking process, the fresh hydrocarbonaceous feed to the coking unit is first introduced into a coker product fractionating column, or fractionator, usually for heat exchange purposes, where it combines with the heavy coker oil products that are recycled as bottoms to the coking unit heater.

In a continuous process like fluid coking the coking reaction takes place in a fluidized coke-bed reactor (450-500 C), while part of the newly formed coke from the reactor is continuously withdrawn and heated in a separate heater vessel with air (500-600 C). This is done for heat balancing the unit and maintaining reactor temperature.

The present inventors assume that the cracking reactions take place at a fixed temperature that are high enough for coke precursors like diolefins to be formed which would in turn require more severe downstream upgrading for conversion to useful middle distillates. In addition, the coking yields from these processes are expected to be high because of the competing side reactions that convert saturates into coke precursors like diolefins and accelerate coke formation from these precursors.

BRIEF SUMMARY OF THE INVENTION

An object of the present invention is to provide a method of sequential cracking wherein the formation of coke is reduced.

Another object of the present invention is to provide a method of sequential cracking wherein the formation of useful products, such as middle distillates, is increased.

Another object of the present invention is to provide a method of sequential cracking wherein the agglomeration of asphaltenes is prevented.

The present invention thus relates to a sequential cracking process for the thermal cracking of a hydrocarbon feedstock in a cascade of cracking units wherein said hydrocarbon feedstock is heated in a furnace to a predetermined maximum temperature and thermally cracked in said cascade of cracking units, the process comprising the following steps:

a. heating said hydrocarbon feedstock in said furnace to a cracking temperature T1;

b. introducing the heated hydrocarbon feedstock into a first cracking unit operating at a temperature T1;

c. passing the product stream from said first cracking unit to a first fractionation;

d. recovering as separate streams from said first fractionation a light fraction boiling below 370[deg.] C. and a heavy fraction boiling above 370[deg.] C.;

e. introducing said heavy fraction from said first fractionation into a second cracking unit operating at a temperature T2;

f. passing the product stream from said second cracking unit to a second fractionation;

g. recovering as separate streams from said second fractionation a light fraction boiling below 370[deg.] C. and a heavy fraction boiling above 370[deg.] C.;

h. introducing said heavy fraction from said second fractionation into a third conversion unit operating at a temperature T3, wherein temperature T1 is not equal to temperature T2, and temperature T2 is not equal to temperature T3, wherein the temperature in the first cracking unit T1, the second cracking unit T2 and the third conversion unit T3 is in the sequence of T1<T2<T3.

According to the present method hydrocarbon feedstock, such as atmospheric or vacuum residue, is fed to a sequential cracking process, where in the first cracking unit operating at a temperature T1 (preferably tubular reactor with a high surface area design) the temperature of the reactor is maintained at a value lower than that of second cracking unit operating at a temperature T2. The residence times in these tubular reactors are short enough to prevent coke precursor formation. The effluent from the first cracking unit operating at a temperature T1 is sent to a first fractionation separator which is operated such that the 370 C-cut is withdrawn as the gaseous product and everything heavier is sent to second cracking unit operating at a temperature T2. The cut temperature is adjusted to keep asphaltenes in solution. The effluent from second cracking unit operating at a temperature T2 is sent to a second fractionation with preferably similar conditions as the first fractionation and the heavier liquid residue is sent to a third conversion unit operating at a temperature T3, where further cracking is allowed to proceed leading to formation of coke and further products. Temperature T3 is higher than temperature T2 and the coker drum for this third conversion step has a much higher reaction time as compared to the upstream conversion reactors.

The separation steps in both the first and second fractionation, i.e. a separator, should be carried out such to prevent the unwanted formation of coke. Therefore, the residence time and the temperature should be kept low. The fractionation is carried out in equipment with minimum internals and probably with specific entry and outlet to cope with the fouling. The product exiting the $1^{st}$ cracking unit or $2^{nd}$ cracking unit or $3^{rd}$ conversion unit would be preferably cooled by a heat exchanger to below 370 deg C. before entering the fractionation step. An example of such a heat exchanger is the type feed-effluent exchanger or heat exchangers using dedicated utilities for effecting this cooling. The effluents resulting from the fractionation have preferably an outlet gas pressure sufficient enough for downstream gas handling, e.g. 0-1 barg. This would ensure that the liquid product leaving the fractionation has very little material boiling below 370 deg C. The liquid product leaving this fractionation is pumped to the required pressure needed for the subsequent reaction stage. The residence times in this fractionation are preferably 5 min or less. According to a preferred embodiment the product exiting $1^{st}$ cracking unit or $2^{nd}$ cracking unit or $3^{rd}$ conversion unit would be cooled by flashing and/or heat exchanging, or a combination of these.

In the present process its is preferred to heat the heavy fraction boiling above 370[deg.] C. from said first fractionation before introducing it into said second cracking unit. It is also preferred to heat the heavy fraction boiling above 370[deg.] C. from said second fractionating before introducing it into said third conversion unit. These heating steps are required to achieve the desired thermal cracking temperature in the respective cracking units. These heating steps can be carried out in different heater furnaces, or the same furnace with different heating banks. The heating steps require short residence times to prevent coke formation.

Thus, the present process provides a sequence of cracking units, wherein the temperature in the first cracking unit T1, the second cracking unit T2 and the third conversion unit T3 is in the sequence of T1<T2<T3, especially the temperature ranges for T1, T2, and T3 are (250[deg.] C.-430[deg.] C.), preferably (380[deg.] C.-420[deg.] C.), (390[deg.] C.-460 [deg.] C.), preferably (410[deg.] C.-460[deg.] C.), and (300 [deg.] C.-530[deg.] C.), preferably (450[deg.] C.-500[deg.] C.). If the third conversion unit is of the type coker drum, T3 is preferably in the range of 440[deg.] C.-530[deg.] C. If the third conversion unit is of the type hydrocracking unit said, T3 is preferably in the range of 300[deg.]C.-530[deg.] C. It is to be noted that the ranges mentioned here for T1, T2 and T3 may show an overlap, but the temperature from T1 to T2 to T3 will increase according to the present method.

According to a preferred embodiment the conditions prevailing in the first fractionation correspond to the conditions prevailing in the second fractionation. The operating conditions in $1^{st}$ cracking unit and $2^{nd}$ cracking unit are such that streams exiting these units have asphaltenes in their dissolved state. The cut point of 370 deg C. for collecting liquids from fractionation has been chosen in order to retain sufficient quantity of resins and aromatics in the stream exiting the respective unit so as to keep asphaltenes in dissolved state. Also, the cut point of 370 deg C. or below is selected so as to remove a suitably upgraded stream from a boiling point perspective out of the conversion zone.

The conversion of the mixed feed is limited in first and second reactors in order to ensure asphaltenes remain in solution. According to the present invention the Saturates, Aromatics, Resins (SAR) portion of the total feed is cracked only in a limited manner, so that (As)phaltenes does not precipitate out. Amongst (S)aturates, (A)romatics, (R)esins, (As)phaltenes, the order of difficulty of conversion to lights is As>R>A>S. Hence with an objective of maximizing conversion of asphaltenes but without precipitating out the present method limits the conversion of R, A, S to keep As in solution. This is a reason for specifying low residence times in the first two cracking units. Thus, the present specification of residence times and temperatures is purposive. Since after every stage of cracking it is preferred to add an asphaltenes-lean solvent the overall composition of the asphaltenes in the combined feed is continuously diminishing while the concentration of S,A,R is continuously increasing. Hence the inventors found to go for complete conversion of asphaltenes with conversion of S,A,R progressively. The final step of the present method could be only SAR conversion. The present inventors found it is possible to conduct any of the present thermal cracking steps at higher pressures which would anyway facilitate keeping lighter solvents in liquid state.

According to a preferred embodiment it is preferred that the residence time of the feedstock in the third conversion unit is longer than the residence time in any one of the first and second cracking unit. In order to prevent unwanted coke formation in both first and second cracking unit short residence times are preferred. Residence times can be shortened by the injection of steam. Residence times in first and second cracking unit are 0-5 min and 0-5 min, respectively.

The present inventors found that the third conversion unit is preferably a coker drum if there is a deficiency in hydrogen. According to another embodiment the third conversion unit is a slurry hydrocracker if there is hydrogen available on site.

As mentioned above, it is preferred to heat the heavy fraction boiling above 370[deg.] C. from said first fractionation before introducing it into said second cracking unit. It is also preferred to heat the heavy fraction boiling above 370[deg.] C. from said second fractionating before introducing it into said third conversion unit. Residence times for the heaters positioned upstream from first cracking unit and second cracking unit are 0-5 min, preferably 0-3 min. Such a heater is a furnace with appropriate length of reaction coil as per residence time and feed rate. The heating as well as conversion occur in the furnace. An additional residence time of 0-3 min is provided after the furnace in the reaction chamber of first cracking unit and second cracking unit which would account for further cracking and coke deposition. The heater for the third conversion unit would have a residence time of 0-5 min and will be followed by a reaction chamber. The residence time in this reaction chamber R-3 will be from 10 min-8 hrs. if this reaction chamber is a coker drum. If the reaction chamber R-3 is a hydrocracker, then WHSV of 0.1-10 hr−1 is employed. Pressures in heater inlets before reaction chamber R-1 or R-2, i.e. for first cracking unit and second cracking unit, are in the range of 10-30 barg. Outlet pressure from R-1 and R-2 are 0-10 barg. Pressures in R-3 (coker) are 0-10 barg, whereas pressures in R-3 (Hydrocracker) are 50-200 barg.

In order to prevent the agglomeration of asphaltenes in a feed it is preferred to mix the feed of at least one of the feed to the $1^{st}$ cracking unit, $2^{nd}$ cracking unit and $3^{rd}$ conversion unit with a solvent. This means that the feed to, for example, the $1^{st}$ cracking unit, is mixed with solvent and the mixture of feed and solvent is subsequently introduced into the $1^{st}$ cracking unit.

Thus, according to a preferred embodiment, the feed to any or all of $1^{st}$ cracking unit, $2^{nd}$ cracking unit and $3^{rd}$ conversion unit is mixed with a solvent and then introduced in the respective heaters before the reactors. The solvent used is primarily liquid at the conditions prevailing in $1^{st}$ cracking unit, $2^{nd}$ cracking unit and $3^{rd}$ conversion unit or their feed heaters. The solvent degrades under the conditions of operations in these reactors and heaters, preferably partly. The conversion of feed and solvent in any reactor of the $1^{st}$ cracking unit, $2^{nd}$ cracking unit and $3^{rd}$ conversion unit is limited to ensuring that asphaltenes remain in a dissolved state and do not precipitate out. The solvent used is preferably rich in aromatics and resins and lean in asphaltenes as compared to the feed to be cracked such that the combined mixture of the feed and solvent prior to entering the $1^{st}$ cracking unit, $2^{nd}$ cracking unit and $3^{rd}$ conversion unit or their heaters has a S value measured as per ASTMD7157-12 of greater than 1. A preferred solvent is vacuum gas oil cut boiling in the range of 350-550 deg C. from petroleum crude oil distillation. Other solvents suitable for this application are crude oil atmospheric tower bottoms, crude oil vacuum tower bottoms, steam cracker cracked distillate, mixed plastic pyrolysis oil and other such streams rich in aromatics that would provide a stable mixture as per criteria above. Mixtures of the afore-mentioned solvents can be used as well, as long as they meet the ASTMD7157-12 requirement. The solvent is mixed with feed in proportions from 1-99 wt % of solvent in the mixture with feed. Preferably the solvent is mixed with feed to result in a 25-95 wt % of solvent in the combined mixture. The present inventors found that a preferred solvent comprises a total concentration of aromatics plus resins in a range of 60-95 wt. %, based on the total weight of the solvent.

The solvent mentioned above is substantially liquid at the prevailing conditions in the cracking units or their feed pre-heaters. This ensures that the solvating power of the solvent doesn't diminish. As compared to prior art, the present invention is hence using wider boiling ranges of the solvent. Typically cracked distillate or decant oil or pyrolysis tar(solvents mentioned in the above discussed EP 0 005 643) would substantially evaporate under the thermal cracking conditions in the cracking units/furnaces as a result of which their full solvating power to keep asphaltenes in solution is not utilized.

An example of a suitable hydrocarbon feedstock comprises hydrocarbons originating from a crude oil distillation unit (CDU) and/or vacuum distillation unit (VDU).

The present invention further relates to the use of a cascade of cracking units for cracking of a hydrocarbon feedstock wherein the thermal cracking conditions from the first to the subsequent cracking unit(s) increase from least severe to most severe. By conducting the present cracking process in a sequential manner and with gradually increasing severity of operation, the formation of coke precursors is delayed until the last step of the process thereby resulting in an overall coke yield that is lower than state of the art known processes such as delayed coking and fluid coking. This means less wt. % of coke precursors such as diolefins and polyaromatics in the final liquid product from the present process, which in turn means the hydrogen requirement for upgrading the liquid products further (in processes such as say, hydrocracking) is less as compared to conventional methods.

In addition, the present invention relates to use of a cascade of cracking units for thermal cracking of a hydrocarbon feedstock for the reduction of the formation of coke.

The present inventors further assume that due to absence of any hydrogen requirement in the present process, the sequential cracking process can become a possible alternative to expensive residue hydrocracking processes. Another embodiment relates to sequential cracking in first and second cracking unit followed by replacement of the coking drum by a slurry hydrocracker optimized for H2 consumption.

BRIEF DESCRIPTION OF THE DRAWINGS

The invention will be described in further detail below and in conjunction with the attached drawing.

FIG. 1 is a schematic illustration of an embodiment of the process of the invention.

DETAILED DESCRIPTION OF THE INVENTION

Referring now to the process and the apparatus 101 schematically depicted in the sole FIGURE, there is shown a crude oil distillation unit (CDU)/vacuum distillation unit (VDU) 1 from which the bottom stream 2 is sent to a heater 15. In a preferred embodiment a solvent stream 25 is mixed with stream 2 before entering first cracking unit 3. The stream 20 thus heated is sent to a first cracking unit 3 operating at a temperature T1. The effluent 4 from the first cracking unit 3 is sent to a cooler 16 and its effluent 21 is sent to a first fractionation 5. The first fractionation separates the effluent 4 from first cracking unit 3 into a light fraction 6 boiling below 370° C. and a heavy fraction 7 boiling above 370° C. The separation here should be carried out such that fouling is minimized, for example with minimum internals and specifically designed entry and outlet ports. Heavy fraction 7 is sent to a heater 17 and its effluent 22 is sent to a second cracking unit 8 operating at a temperature T2. In a preferred embodiment a solvent stream 26 is mixed with stream 7 before entering second cracking unit 8. The effluent 9 from the second cracking unit 8 is sent to a cooler 18 and its effluent 23 is sent to a second fractionation 10, which fractionation 10 provides a light fraction 11 boiling below 370° C. and a heavy fraction 24 boiling above 370° C. Heavy fraction 24 from second fractionation 10 is sent to a heater 19 and its effluent 12 is sent to a coking unit 14, e.g. a coker drum, operating at a temperature T3. In a preferred embodiment a solvent stream 27 is mixed with effluent 12 before entering coking unit 14. Coking unit 14 provides an effluent 13. The step of cooling in cooler units 16, 18 can be carried out by flashing and/or heat exchanging, or a combination thereof.

The temperature ranges for T1, T2 and T3 are (250-430)° C., (390-450)° C. and (440-530)° C., respectively.

It should be appreciated that the example below is merely exemplary, and is not intended to be limiting.

Example

A combined feed is prepared by mixing a 10% by weight Arab heavy vacuum residue (SARA analysis 5.4/10.4/60.3/23.9) with 90% by weight Jinzhou vacuum residue (17.2/29.6/51.3/1.9) upstream of first cracking unit and heated to a temperature of 410 deg C. The effluent from first cracking unit reactor is separated into gas stream and a liquid stream boiling above 370 deg C. by fractionation. The liquid boiling above 370 deg C. is heated in a 2nd heater to 450 deg C. and fed second cracking unit R-2. The effluent from R-2 is separated again into a gas stream and a liquid boiling above 370 deg C. This liquid boiling above 370 deg C. is fed to a coker drum operating at 450-530 deg C. Alternatively this liquid boiling above 370 deg C. from 2nd fractionation is fed to a hydrocracker, preferably a slurry hydrocracker, operating at 300-530 deg C. The combined feed to first cracking unit reactor and the streams exiting first cracking unit reactor and second cracking unit reactor or their heaters are evaluated as per ASTM D7157-12 to ensure asphaltenes are stable and dissolved. Reactor or heater temperatures are adjusted to ensure these stable solutions.

The invention claimed is:

1. A sequential cracking process for the thermal cracking of a hydrocarbon feedstock in a cascade of cracking units wherein said hydrocarbon feedstock is heated in a furnace to a predetermined maximum temperature and thermally cracked in said cascade of cracking units, the process comprising the following steps:

a. heating said hydrocarbon feedstock in said furnace to a cracking temperature T1;

b. introducing the heated hydrocarbon feedstock into a first cracking unit operating at a temperature T1;

c. passing the product stream from said first cracking unit to a first fractionation;

d. recovering as separate streams from said first fractionation a light fraction boiling below 370° C. and a heavy fraction boiling above 370° C.;

e. introducing said heavy fraction from said first fractionation into a second cracking unit operating at a temperature T2;

f. passing the product stream from said second cracking unit to a second fractionation;

g. recovering as separate streams from said second fractionation a light fraction boiling below 370° C. and a heavy fraction boiling above 370° C., and h. introducing said heavy fraction from said second fractionation into a third conversion unit operating at a temperature T3, wherein temperature T1 is not equal to temperature T2, and temperature T2 is not equal to temperature T3, wherein the temperature in the first cracking unit T1, the second cracking unit T2 and the third conversion unit T3 is in the sequence of T1<T2<T3, and wherein the product exiting said first cracking unit is cooled by a heat exchanger before entering said first fractionation.

2. The process according to claim 1, wherein said heavy fraction from said first fractionation is heated before introducing into said second cracking unit.

3. The process according to claim 1, wherein said heavy fraction from said second fractionation is heated before introducing into said third conversion unit.

4. The process according to claim 1, wherein the temperature ranges for T1, T2, and T3 are 250° C. to 430° C., 390° C. to 460° C., and 300° C. to 530° C., respectively, wherein T3 is in the range from 440° C. to 530° C. if said third conversion unit is a coker drum, wherein T3 is in the range from 300° C. to 530° C. if said third conversion unit is a hydrocracking unit.

5. The process according to claim 1, wherein the conditions prevailing in said first fractionation correspond to the conditions prevailing in said second fractionation.

6. The process according to claim 1, wherein the residence time of the feedstock in said third conversion unit is longer than the residence time in any one of said first and second cracking unit.

7. The process according to claim 1, wherein said hydrocarbon feedstock comprises hydrocarbons originating from at least one member selected from the group consisting of a crude oil distillation unit (CDU) and vacuum distillation unit (VDU).

8. The process according to claim 1, wherein the feed to at least one of said first cracking unit, said second cracking unit and said third conversion unit is mixed with a solvent before introducing the mixture of feed and solvent into the respective unit, wherein said solvent comprises a total concentration of aromatics plus resins in a range of 60-95 wt. %, based on the total weight of the solvent.

9. The process according to claim 8, wherein said combined mixture of the feed and solvent prior to entering to at least one of said first cracking unit, said second cracking unit and said third conversion unit has a S value, measured as per ASTMD7157-12, of greater than 1.

10. The process according to claim 8, wherein said solvent is a vacuum gas oil cut boiling in the range of 350° C. to 550° C. from petroleum crude oil distillation, and said solvent is chosen from the group including crude oil atmospheric tower bottoms, crude oil vacuum tower bottoms, steam cracker cracked distillate and mixed plastic pyrolysis oil, or a combination thereof.

11. A sequential cracking process for the thermal cracking of a hydrocarbon feedstock in a cascade of cracking units wherein said hydrocarbon feedstock is heated in a furnace to a predetermined maximum temperature and thermally cracked in said cascade of cracking units, the process comprising the following steps:

a. heating said hydrocarbon feedstock in said furnace to a cracking temperature T1;

b. introducing the heated hydrocarbon feedstock into a first cracking unit operating at a temperature T1;

c. passing the product stream from said first cracking unit to a first fractionation;

d. recovering as separate streams from said first fractionation a light fraction boiling below 370° C. and a heavy fraction boiling above 370° C.;

e. introducing said heavy fraction from said first fractionation into a second cracking unit operating at a temperature T2;

f. passing the product stream from said second cracking unit to a second fractionation;

g. recovering as separate streams from said second fractionation a light fraction boiling below 370° C. and a heavy fraction boiling above 370° C., and h. introducing said heavy fraction from said second fractionation into a third conversion unit operating at a temperature T3, wherein temperature T1 is not equal to temperature T2, and temperature T2 is not equal to temperature T3, wherein the temperature in the first cracking unit T1, the second cracking unit T2 and the third conversion unit T3 is in the sequence of $T1<T2<T3$, and wherein said third conversion unit is a slurry hydrocracker.

* * * * *